US008177512B2

(12) United States Patent
Mosiewicz

(10) Patent No.: US 8,177,512 B2
(45) Date of Patent: May 15, 2012

(54) HUB-PROFILE CONNECTION SYSTEM FOR AXIAL FAN AND AXIAL FAN PROVIDED WITH THIS CONNECTION SYSTEM

(76) Inventor: Roberto Eduardo Mosiewicz, Stresa (IT)

( * ) Notice: Subject to any disclaimer, the term of this patent is extended or adjusted under 35 U.S.C. 154(b) by 838 days.

(21) Appl. No.: 12/220,977

(22) Filed: Jul. 29, 2008

(65) Prior Publication Data

US 2009/0035139 A1 Feb. 5, 2009

(30) Foreign Application Priority Data

Jul. 31, 2007 (EP) ..... 07425496

(51) Int. Cl.
*F04D 29/24* (2006.01)
*F04D 29/36* (2006.01)

(52) U.S. Cl. ..... 416/204 R; 416/205

(58) Field of Classification Search ..... 416/15, 416/240 R, 210 R, 233 R, 226, 227 R, 229 R, 416/232, 233, 240, 241 R, 241 A, 134 R, 416/204 R, 205
See application file for complete search history.

(56) References Cited

U.S. PATENT DOCUMENTS

| | | | | |
|---|---|---|---|---|
| 1,501,201 | A | 7/1924 | Cates | |
| 6,884,035 | B2 | 4/2005 | Young | |
| 2004/0009064 | A1 * | 1/2004 | Young | 416/5 |
| 2006/0024165 | A1 | 2/2006 | Gajewski | |
| 2006/0140770 | A1 | 6/2006 | Liu | |
| 2006/0278766 | A1 * | 12/2006 | Wang | 248/74.1 |

FOREIGN PATENT DOCUMENTS

| | | |
|---|---|---|
| EP | 1 571 345 A | 9/2005 |

OTHER PUBLICATIONS

S. F. Elermeyer, Arc Length and Curvature, p. 7, line 12 from top—at www.math.kennesaw.edu/~sellerme/sfehtml/classes/.../curvature.pdf.*
Bulk Modulus p. 5 at http://www.answers.com/topic/bulk-modulus-2.*
Bulk Elastic Properties at http://hyperphysics.phy-astr.gsu.edu/hbase/permot3.html.*
S. F. Elermeyer, "Arc Length and Curvature" Apr. 2004.*
Bulk Modulus Mar. 2008.*
Bulk Elastic Properties Apr. 2005.*
European Search Report completed Dec. 19, 2007 by the European Patent Office in priority European application No. EP07425496.2.

* cited by examiner

*Primary Examiner* — Thomas L Dickey
*Assistant Examiner* — Nikolay Yushin
(74) *Attorney, Agent, or Firm* — Abelman, Frayne & Schwab

(57) ABSTRACT

A hub-profile connection system for axial fan is disclosed, consisting of a hub to which one or more blades provided with an air displacement profile are connected, wherein one or more blades are attached in a flexible manner to the hub by means of two separate flexible elements, both fixed, reciprocally distinct, separate and overlapped one to the other in the fan axis direction on the hub side, to a fastening block and, on the blade side, to a corresponding fastening block. Compared with the known rigid, hinged and flexible constraint systems, the system of the present invention offers lower static and dynamic loads, as well as construction simplicity, with consequent cost saving and vibration abatement.

20 Claims, 2 Drawing Sheets

HUB-PROFILE CONNECTION SYSTEM FOR AXIAL FAN AND AXIAL FAN PROVIDED WITH THIS CONNECTION SYSTEM

FIELD OF THE INVENTION

The present invention relates to a hub-profile connection system for axial fan. The same invention further extends to the axial fan provided with this connection system.

PRIOR ART

Axial fans are commonly used where large amounts of air need to be moved, overcoming even high static pressures, specifically in the systems in which the air is used for cooling by means of heat exchange. In this case, fans are used which may reach-very large diameters, even twenty meters.

In the design of this type of fan, the connection between hub and part of the blade intended to displace the air, hereinafter called profile, is a particularly important issue, because the stresses here reach their maximum and such connection is thus a zone subject to breakage risks.

SUMMARY OF THE INVENTION

It is the main object of the present invention to provide a hub-profile connection system for axial fans, which, in relation to the known hinged or flexible rigid constraint connection systems, presents low static and dynamic loads, a better construction simplicity and a-higher resistive moment.

These and other objects are reached by the hub-profile connection system and by the axial fan of claims 1 and 9, respectively. Preferred manners for manufacturing the invention result from the remaining claims.

In relation to the known art, the hub-profile connection system of the present invention offers the following advantages:

- compared with rigid constraint systems, lower static and dynamic loads, with consequent cost saving and vibration abatement;
- with respect to hinged constraint systems, a particular construction simplicity, the possibility of graduating the freedom of movement on the vertical, plane as desired and the absence of wear;
- unlike flexible constraint connection systems, a higher resistive moment (and thus the possibility of using more cost-effective materials with lower mechanical features, the section being equal), a higher torsional strength and a higher rigidity on the vertical plane (with consequent solution of the problem of excessive profile lowering in large diameter fans).

Compared with the known rigid, hinged and flexible constraint systems, the system of the invention and the axial fan of the present invention offer lower static and dynamic loads, as well as construction simplicity, with consequent cost saving and vibration abatement. With respect to hinged constraint systems, the present invention offers advantages of a particular construction simplicity, and the possibility of graduating the freedom of movement on the vertical plane as desired and the absence of wear. Unlike flexible constraint connection systems, the present invention also displays a. higher resistive moment and thus the possibility of using more cost effective materials with lower mechanical features, assuming the section being equal. It also displays a higher torsional strength and a higher rigidity on the vertical plane, with consequent solution of the problem of excessive profile lowering in large diameter fans.

BRIEF DESCRIPTION OF THE FIGURES

These and other objects, advantages and features will result from the following description of a preferred embodiment of the hub-profile connection and the axial fan of the present invention shown, by way of non-limitative example, in the FIGS. of the accompanying drawings, wherein.

DETAILED DESCRIPTION OF THE INVENTION

Figures 1, 2, 3, 4:
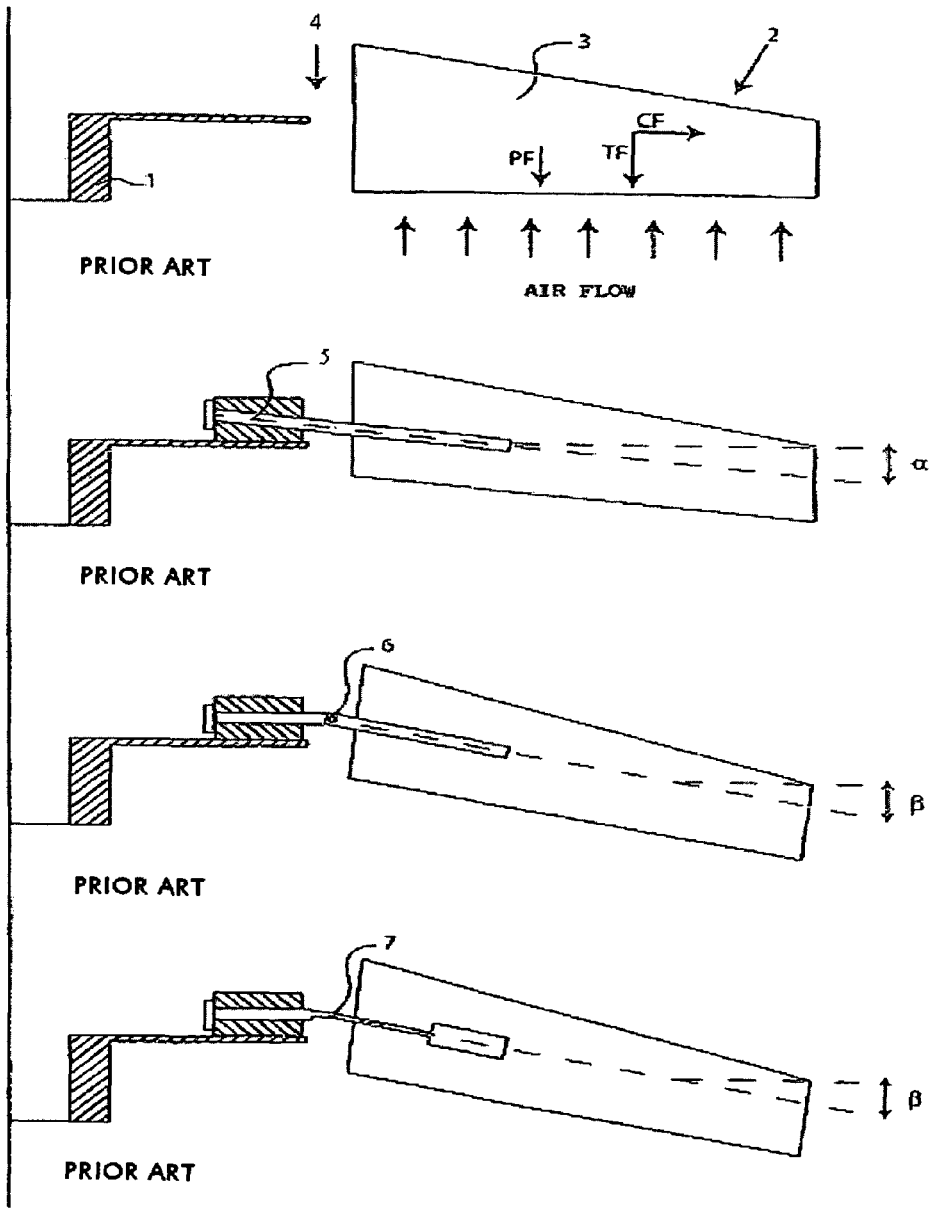
FIG. 1 PRIOR ART
FIG. 2 PRIOR ART
FIG. 3 PRIOR ART
FIG. 4 PRIOR ART
FIG. 1 shows the diagram of the most important forces which act on the blades of a running axial fan.
FIGS. 2, 3 and 4 show hub-profile connection systems made according to the known art.

For a better understanding of the system according to the present invention, FIG. 1 shows the most important forces acting on a running axial fan blade, i.e. centrifuge force CF, having radial direction, the traction aerodynamic force TF, with axial direction, and weight force PF, with axial direction.

These forces generate a bending moment and a torque, with static and dynamic loads which are particularly relevant for the structural dimensioning calculations of the fan. A reduction of these moments allows important savings.

Connection 4 between hub 1 and profile 3 of blade 2 of an axial fan is currently mainly made in three ways: with a rigid system, with a hinged system and with a flexible system.

The three cases will be briefly described, indicating the main advantages and the disadvantages thereof, in order to compare them with the invention and highlight its superiority.

In the case of a rigid system connection (FIG. 2), the hub-profile connection is made with an element 5, rigid both on the rotation plane and on the reciprocally perpendicular plane, typically with circular section the rigidity of which is of the order of size of the profile. A contrivance used in this case to reduce the bending moment and the stresses thereby generated, which are here the maximum, is to incline the axis of the blade with respect to the rotation plane, in the opposite direction to that of the air flow, creating an angle a. This inclination, given the rigidity of the element, will be fixed. With this contrivance, according to the profile, the fan, in virtue of the centrifuge force, may develop a moment of direction opposite to that generated by the traction force, thus reducing the bending moment. The system however has the drawback of being ineffective in relation to dynamic loads.

In the known hinged connection systems (FIG. 3), the hub-profile connection is made by means of a hinge 6 the axis of which is perpendicular to the rotation axis. In this case, while the fan is running, the profile is free to-rotate on the vertical plane, continuously positioning itself in a zone where the centrifuge force allows the profile to generate a moment of entity and direction opposite to that generated by the traction force, tending to cancel the bending moment. Angle β created by the blade with-the rotation plane varies in this case. The system hereto described has the main disadvantage that the fan blades, due to the freedom conferred to them by the hinge, tend to unlimitedly lower themselves, and thus need a resting point in stopped fan condition. Furthermore, this system is very sensitive to the action of the wind and there is a relative movement between the hinge parts with inevitable wear in time.

Finally, in the case of flexible connections (FIG. 4), the hub-profile connection consists of a thin element 7, rigid on the rotation plane, but provided with high flexibility on the plane perpendicular to the rotation plane. While the fan is running, the element will bend and its section will rotate, allowing the profile to rotate on the vertical plane and continuously position itself in a zone where the centrifuge force allows the profile to generate a moment of direction opposite to that of traction. Also in this case, angle β varies in the course of operation. The longitudinal section of the flexible element will have a parabolic pattern with maximum deformation on the hub side, with the drawbacks of excessive lowering of the blades in large diameter fans and a poor torsional strength of the flexible element. Therefore, under the action of the torque, it tends to come askew, stiffening and changing the pitch setting of the profile.

Figure 5:
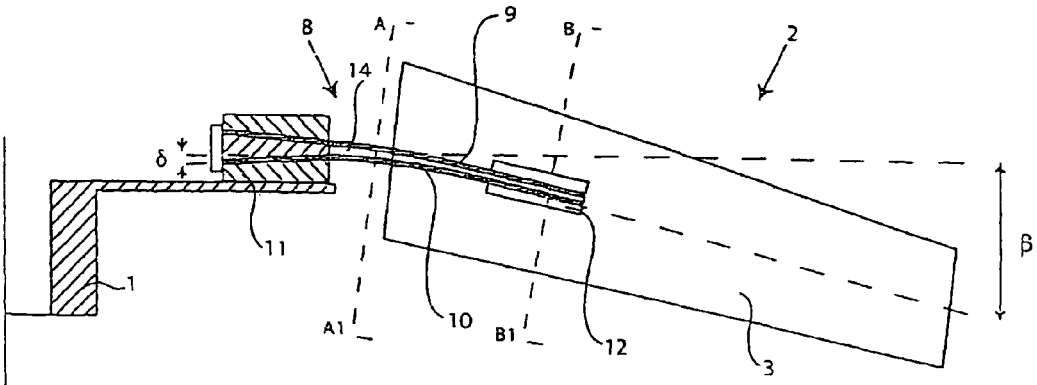
FIG. 5 shows a diagrammatic side view of the system of the invention.
Figure 6:
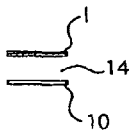
FIGS. 6 and 7 show the system in FIG. 5, along section A-A1 and B-B1, respectively.

The hub 1 profile 3 connection system made according to the invention, as shown in FIG. 5, is formed by an assembly 8 comprising two flexible elements 9,10 of preferably rectangular section which, in the segment comprised between two fastening blocks, 11 on hub 1 side and 12 on profile 3 side respectively, are separated by a gap 14. The two elements 9,10 are thus respectively distinct and separate. Obviously, the forces present when the fan is running will act on the two elements in different manner, because they will be deformed in equally different manner.

Figure 7:
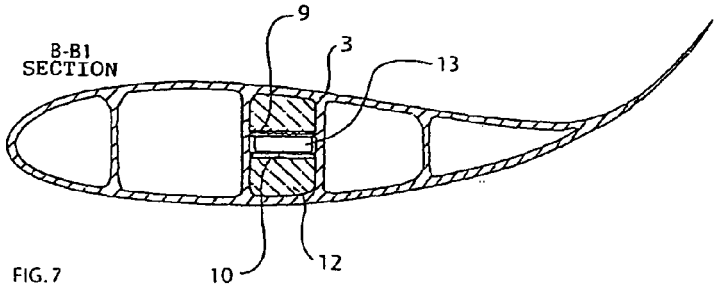

The same elements 9,10 on profile 3 side may either come into direct contact or a spacer 13 may be interposed between the same (FIG. 7). The mentioned spacer may be formed by a material with a lower modulus of elasticity than that of the two mentioned elements and, therefore, when blade 2 is subjected to the typical operating loads, it will allow elements 9 and 10 themselves to reciprocally slide, so as to determine a greater rotation of the sections, the load being equal.

Figure 8:
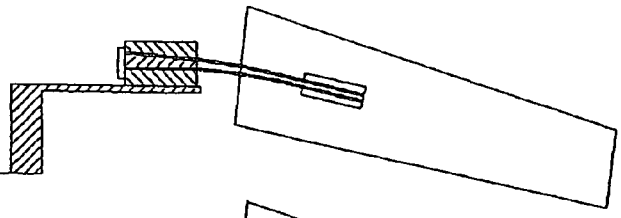
FIGS. 8 and 9 show two different variant embodiments of the system of the invention.
Figure 9:
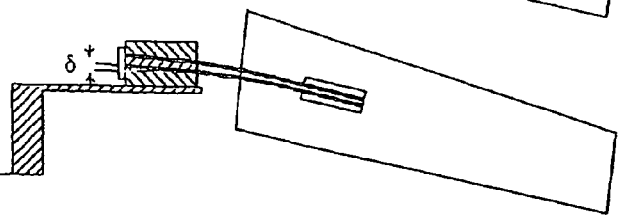

Angle δ of lower element 10 may be either positive, or negative as shown in FIG. 9, or equal to zero (as shown in FIG. 8) with respect to the rotation plane (FIG. 5).

Furthermore, the two elements may be tapered, have reciprocally different geometries, both in section and in plan, or even be formed by different materials.

The use of two separate and distinct elements, which may be made as above and reciprocally positioned in space as desired, allows to design a hub-profile connection with variable resistance modulus, maximum on hub side and decreasing in the direction of the profile, and thus to obtain that when the profile is subjected to the operating loads, the sections rotate presenting an angle with ever greater increases with respect to the vertical. The longitudinal section of elements 9,10 may have an arc of a circle or parabolic pattern, with maximum curvature on the profile side.

The connection system will allow the profile to incline itself with respect to the horizontal plane, continuously positioning itself in a zone in which the centrifuge force allows the profile to generate a force of entity and direction opposite to that of traction, tending to cancel the bending moment. The system itself will also present a high degree of displacement on the vertical plane, thus reducing both the dynamic and the static loads. The present invention will allow this to occur in extremely controlled manner, as not possible according to the known techniques.

In order to facilitate the understanding of the present invention, the simplest fixing solution of a blade to the hub, i.e. the one in which the blade is not adjustable, is shown in drawings 5, 8 and 9. It is must be underlined that fastening blocks 11 and 12 may also be designed so as to provide the blade with the possibility of being keyed and the invention is applied also to this type of fan.

The invention claimed is:

1. A hub-profile connection system for axial fan, consisting of a hub (1) to which one or more blades (2) provided with an air displacement profile (3) are connected, wherein said one or more blades (2) are attached in flexible manner to said hub (1) by means of two flexible elements (9,10), both fixed, reciprocally distinct, separate and overlapped one to the other in the fan axis direction, on the hub side to a fastening block (11) and, on blade side (2), to a corresponding fastening block (12).

2. A system according to claim 1, characterized in that each said separate and distinct flexible element (9,10) has a longitudinal section with an of circle, or parabolic pattern with maximum curvature on the portion of said elements (9,10) accommodated in said profile (3) of said blade (2).

3. An axial fan, characterized in that it is provided with a hub-profile connection system according to claim 1.

4. A system according to claim 1, characterized in that a lower element (10) of said two flexible and distinct flexible elements is fixed to said fastening block (11) on the hub side with a positive, negative or zero angle (δ), with respect to the plane of rotation of the fan.

5. A system according to claim 4, characterized in that each said flexible elements (9,10) are reciprocally separate in the section included by a gap (14) between said respective fastening blocks (11,12).

6. A system according to claim 1, characterized in that each said flexible elements (9,10) are reciprocally separate in the section included by a gap (14) between said respective fastening blocks (11,12).

7. A system according to claim 6, characterized in that said flexible elements (9,10) converge in direct contact on said corresponding fastening block (12) on the profile (3) of said blade (2).

8. A system according to claim 7, characterized in that each said separate and distinct flexible element (9,10) has a rectangular cross-section.

9. A system according to claim 7 characterized in that each said separate and distinct flexible element (9,10) has a longitudinal section with an of circle, or parabolic pattern with maximum curvature on the portion of the same elements (9,10) accommodated in said profile (3) of said blade (2).

10. A system according to claim 6, characterized in that each said separate and distinct flexible element (9,10) has a rectangular cross-section.

11. A system according to claim 6, characterized in that each said separate and distinct flexible element (9,10) has a longitudinal section with an of circle, or parabolic pattern with maximum curvature on the portion of the same elements (9,10) accommodated in said profile (3) of said blade (2).

12. A system according to claim 6, characterized in that a spacer (13) is interposed between said separate and distinct fastening elements (9,10) at their fastening section on said block (12) on the blade side.

13. A system according to claim 12, characterized in that said each separate and distinct flexible element (9,10) has a longitudinal section with an of circle, or parabolic pattern with maximum curvature on the portion of the same elements (9,10) accommodated in said profile (3) of said blade (2).

14. A system according to claim 12, characterized in that said spacer (13) has a lower modulus of elasticity than that of each of said two separate and distinct flexible elements (9,10).

15. A system according to claim 12, characterized in that each said separate and distinct flexible element (9,10) has a rectangular cross-section.

16. A system according to claim 14, characterized in that each said separate and distinct flexible element (9,10) has a rectangular cross-section.

17. A system according to claim 14, characterized in that said each separate and distinct flexible element (9,10) has a longitudinal section with an of circle, or parabolic pattern with maximum curvature on the portion of the same elements (9,10) accommodated in said profile (3) of said blade (2).

18. A system according to claim 16, characterized in that said each separate and distinct flexible element (9,10) has a longitudinal section with an of circle, or parabolic pattern with maximum curvature on the portion of said elements (9,10) accommodated in said profile (3) of said blade (2).

19. A hub-profile connection system for axial fan, which comprises a hub having one or more blades connected thereto, each said blade provided with an air displacement profile, said one or more blades being attached to said hub in flexible manner by means of two flexible elements, both said elements being fixed, reciprocally distinct, separate and overlapped one to the other in the fan axis direction, on the hub side to a fastening block and, on the blade side, to a corresponding fastening block, said lower element being fixed to said block on the hub side with a positive, negative or zero angle with respect to the plan rotation of the fan.

20. An axial fan provided with a hub-profile connection system, which comprises one or more fan blades connected thereto, each said blade provided with an air displacement profile, said one or more blades being attached to a hub in flexible manner by means of two flexible elements, both fixed, reciprocally distinct, separate and overlapped one to the other in the fan axis direction, on the hub side to a fastening block and, on the blade side, to a corresponding fastening block.

* * * * *